United States Patent [19]

Nathan et al.

[11] Patent Number: 4,550,838

[45] Date of Patent: Nov. 5, 1985

[54] MODULAR DISPLAY RACK

[75] Inventors: Walter Nathan, Glencoe; Armand S. Zucker, Skokie, both of Ill.

[73] Assignee: RTC Industries, Inc., Chicago, Ill.

[21] Appl. No.: 586,222

[22] Filed: Mar. 5, 1984

[51] Int. Cl.[4] ..... A47F 3/14

[52] U.S. Cl. ..... 211/128

[58] Field of Search ..... 211/128, 126, 10, 11; 220/23.6; 229/DIG. 11; 206/821, 555; D19/DIG. 92

[56] References Cited

U.S. PATENT DOCUMENTS

| | | | |
|---|---|---|---|
| D. 162,990 | 4/1951 | Roeder | 211/128 X |
| 2,575,919 | 11/1951 | Kautzmann | 211/126 |
| 2,901,120 | 8/1959 | Abrahamson | 211/126 |
| 2,916,293 | 12/1959 | Lang | 211/126 X |
| 3,095,093 | 6/1963 | Pelab | 211/126 |

*Primary Examiner*—Ramon S. Britts

*Assistant Examiner*—Sarah A. Lechok

*Attorney, Agent, or Firm*—Norman Lettvin

[57] ABSTRACT

An improved, knock-down, multiple-level, article storage and display rack may be assembled using article storage and shipping containers and dowel rod spacers. The containers, which preferably are molded plastic trays, each have a rectangular base and three retaining walls, one of which is a front wall. A display panel is angled forward from the container's front wall so that the bottom of the display panel and the bottom of the front wall cooperate to provide front, horizontal, support. A simple stand constructed to provide a pair of upright columns that fit into bottom-opening recesses in the two side walls, cooperate to provide a rear suppport for the display. Column-like dowels that fit into upper and lower recesses in the retaining walls of respective lower and upper trays are used to assemble the vertically disposed display rack.

14 Claims, 4 Drawing Figures

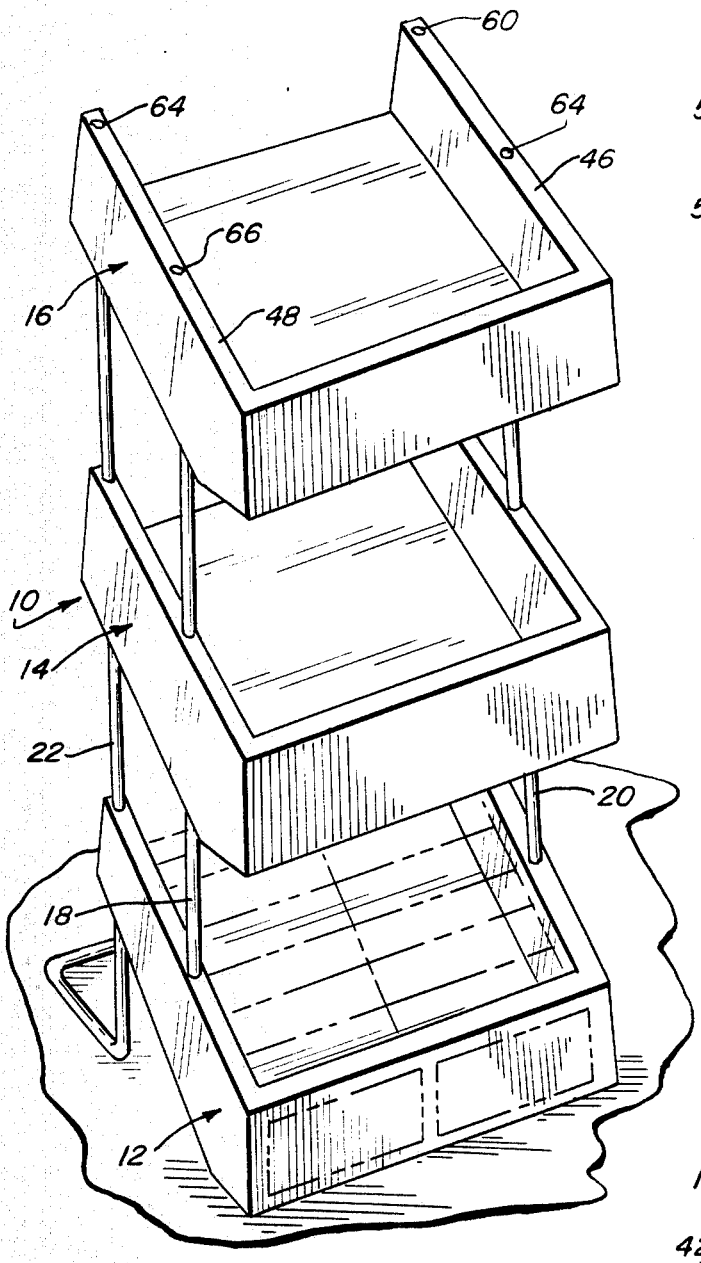
FIG. 1
FIG. 3
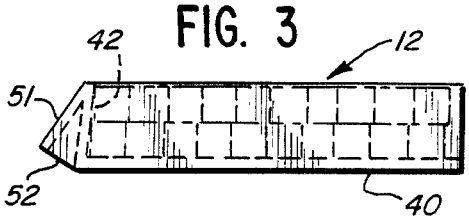
FIG. 4
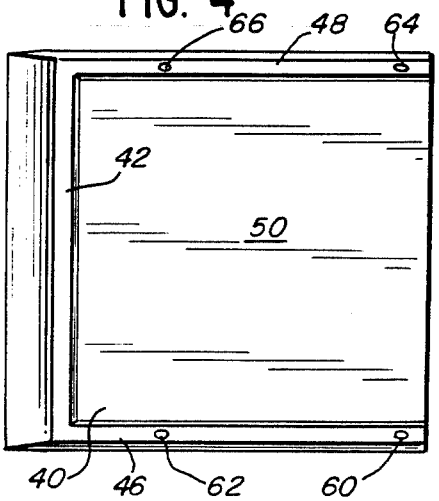
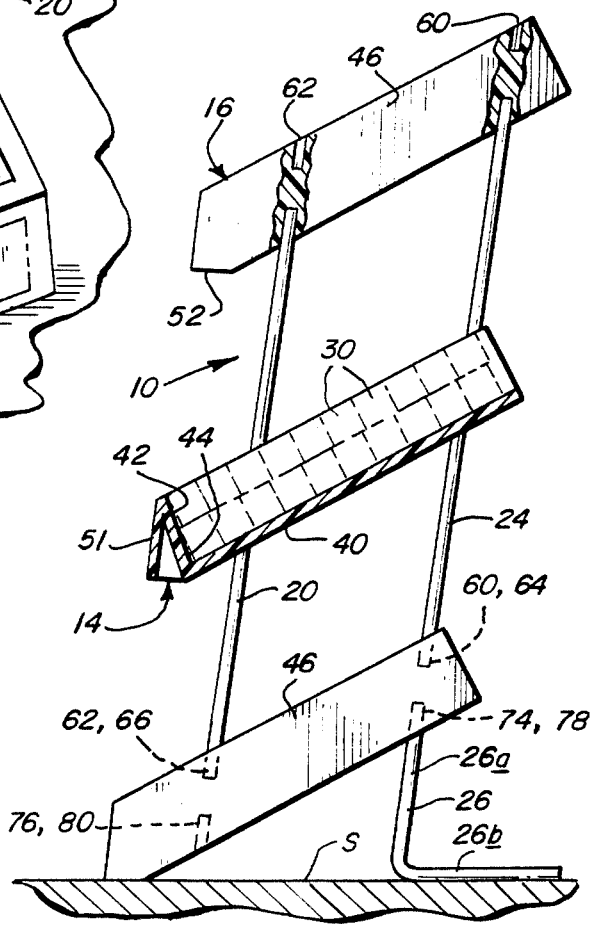
FIG. 2

MODULAR DISPLAY RACK

This invention relates to modular packing and shipping containers and to display stands formed therefrom. More particularly this invention relates to a simple, inexpensive, but effective, multi-tiered, modular display rack made of an assembly of trays each of which may also be used as a separate storage and shipping container for the articles to be placed on display.

BACKGROUND OF THE INVENTION

Articles for sale in stores are often placed in multi-tiered, vertical, display racks where the articles are efficiently displayed. At the same time the display permits customer access to multiple articles displayed on limited counter space occupied by the rack. Multi-tiered, vertical, display racks are, therefore, a desirable part of merchandising, particularly with respect to vending small packaged articles such as candy bars or packages of wrapped chewing gum strips.

Known display racks are often bulky and unwieldly. Furthermore, if the articles to be displayed for sale are in their shipping container, the number of such shipping containers displayed is frequently limited by the counter space available in the shop.

It would be desirable to be able to provide shipping containers for multiple packaged articles that are easily convertible to multi-tiered counter display stands that display large quantities of goods within limited counter space.

SUMMARY OF THE INVENTION

A feature of a preferred embodiment of the present invention is the improvement of providing a simple and inexpensive, knockdown, article storage and display rack. The rack is to be assembled using article storage and shipping containers arranged in an upright, multi-tiered display intended for support on a horizontal counter top used in retail stores and the like.

The improvement comprises using generally flat, goods-containing, shippers that are of modified shape at their forward side, and whose spaced side edges are provided with inclined bores or recesses therein. The purpose is so that by using simple dowel-like, rod spacers, for fitting into the inclined bores, and using a modified shape at the forward side of the shipper, together with an inexpensive rear stand, an inexpensive, multi-tiered, inclined display stand may be provided for use by the shop keeper.

Each of the trays includes a substantially rectangular base and at least three adjacent upright retaining walls connected to and extending transversely above the base along at least the front and two side edges of the base. The height of the retaining walls is selected to provide lateral restraint for the packaged goods packed in and on the tray. Each tray also includes an inclined, front display panel which is shaped and arranged to provide means for carrying an advertising display. The display panel is secured to an upper portion of the middle one of the three upright walls, the portion being inclined outwardly and downwardly from the tray wall to a level spaced above the plane of the lowermost side of the base. The bottom of the display panel then forms, with the bottom of the front edge of the base, a sturdy front support, which, together with an inexpensive rear stand member, provides means for horizontal support for a tray when the tray is disposed at its inclined display position. A rear stand connects to the lowermost tray of a multi-tiered display, and cooperates with the front support to maintain the multi-tiered display at a stable attitude on a horizontal counter top.

In one embodiment, the two walls adjacent the opposite sides of each tray are provided with elongated bores, or recesses, in the upper and lower edges adapted to cooperate with rod-like, dowel or column members, which are received by the bores, or recesses, to permit stacking the plurality of trays as a display array.

Experience has shown that there exists a desired, or preferred, display angle which makes contents of a tray readily visible to customers but does not permit display items to fall out of the tray. This display angle, measured relative to horizontal, is between about 20° and 40° and is incorporated as yet another feature in an embodiment of the present invention.

It is accordingly one object of this invention to provide an improved and inexpensive known-down, article storage and display rack.

Another object of the present invention is to provide a display rack making use of identical trays that are suitable for use as article storage and prepacked shipping containers for articles to be placed on display.

These and other objects, advantages, and features of the invention, as well as many of the particular advantages, will become readily apparent from the following detailed description of one specific construction of an embodiment which is presented in conjunction with the accompanying drawings.

BRIEF DESCRIPTION OF THE DRAWINGS

With reference to the accompanying sheet of drawings:

FIG. 1 is a perspective view of one form of a multiple-tiered article storage and display rack that embodies features of the present invention.

FIG. 2 is a side view of the display rack shown in FIG. 1.

FIG. 3 illustrates one of the article containers, such as those included in the display rack of FIG. 1, serving as a flat shipping container with packaged articles stored therein; and FIG. 4 is a top plan view of the shipping container shown in FIG. 3.

DETAILED DESCRIPTION OF A PREFERRED EMBODIMENT

As may be seen with respect to FIG. 1, a simple, inexpensive, improved, knock-down, multi-tiered article storage and display rack may take the form of an exemplary display array 10 comprising a plurality of substantially identical trays such as the trays 12, 14, 16. Each tray is suitable for use, as seen in FIGS. 3 and 4, as an article storage and shipping container for the articles to be placed on display. Each adjacent pair of trays in the multi-tiered, vertical, array, is connected by four vertical supports, or column members, of which the exemplary supports 18, 20, and 22 may be seen in FIG. 1, and the exemplary supports 20 and 24 may be seen in FIG. 2. A connectible base 26 is connected to the bottom tray 12 in the array to help provide a stable base for the multi-tiered vertical array. The array accordingly functions as an easily assembleable upright display.

Individual trays, such as the tray 12, may also be used for individual shipping purposes, as indicated by FIGS. 3 and 4. The trays, without the supports 18, 20, 22, 24 are horizontally stackable, one upon another, to make a compact shipping package.

When the display is assembled and placed upon a horizontal surface, such as a counter or shelf in a shop, the trays are disposed at an angle, as may be seen more clearly in FIG. 2. The angle is such that the rear of each tray is elevated with respect to the front. Accordingly goods such as, for example, candy bars or packages of chewing gum 30 that are located in the tray are visible for display and tend to slide toward the front of the tray to be accessible to the vendor or to customers. Experience has shown that the angle, that is indicated in FIG. 2, should preferably be between about 20° and 40° in order to insure that goods on display will be seen and will slide to the front of the tray without falling out.

Each tray, such as the typical tray 12, comprises an integrally molded plastic structure comprising a unitary part having a substantially rectangular basepiece 40 with three integral upright walls. A substantially rectangular upright front wall 42 connects along a front edge of the basepiece 40 to provide a substantially right-angled corner 44 which may be seen in the section view in FIG. 2. The corner runs along the width of the front wall, and a pair of side walls 46, 48 connect to opposing other edges of the basepiece 40 and to the front wall to provide a box-like, approximately parallelepiped, cavity 50 which is enclosed on three upright sides that project above the basepiece 40. Each tray accordingly includes a substantially rectangular base 40 and three adjacent upright, retaining, planar walls 42, 46 and 48, integral with and extending transversely above the base 40 along the front and two side edges of the base. The height of the three upright walls is selected to provide lateral restraint for packaged goods packed in and on the tray 12.

The side walls 46 and 48 may, if desired, project forward of the front wall 42 to connect to the end lateral edges of a front display panel 51. The display panel is of substantially identical width to the width of front wall 42, and display panel 51 connects to the upper edge of the front wall 42 by the upper one of its transversely extending edges. The display panel 51 and front wall 42 accordingly provide an acute-angled wedge-shaped cavity bounded at the ends by the side walls 46 and 48. The display panel 51 is of a selected size and shape suitable for carrying an advertising display.

The bottom edges of side walls 46, 48 are flush with the under surface of base 40. Forwardly of the base 40, the side walls 46 and 48 are each shaped to define a bottom support edge 52 which is co-planar with the bottom edge of the display panel 51. The support edge 52 lies at an acute angle with the under side of the base 40. The display panel 51 provides means secured to an upper portion of the middle wall 42 of the three upright walls of the tray. The display panel 51 is inclined forwardly and downwardly from the wall 42 to a level spaced above the plane of the under side of the base 40, thereby forming, with the front edge of the base, 40, a front support or support means for the tray when the tray is disposed in its inclined display position.

The side walls 46 and 48 are provided with bores therein that open through the edges of the side walls, as best seen in FIG. 2, by the respective pairs of holes 60, 62 and 64, 66 in sides 46 and 48. The holes 60 and 62 are co-planar with the plane of side wall 46 and holes 64 and 66 are co-planar with the plane of side wall 48. The planes of the side walls 46 and 48 are the respective regions bounded by spaced parallel side surfaces that bound the respective side walls. The bottom holes 74, 76 and 78, 80 and top holes 60, 62 and 64, 66 are respectively aligned as seen in FIG. 2, and opposed, but are generally not sufficiently axially elongated to meet. The holes are sized to receive the ends of rod-like supports, such as the supports 18, 20, and 22 in dowel fashion.

Accordingly, as shown in FIG. 2, the support 18 is fitted into a top hole 60 of one tray and a corresponding bottom hole 74 of another tray. The four support rods between each pair of trays are substantially vertical and parallel with respect to each other, as seen in FIG. 2. The supports, such as support 18, 20, and 22, may comprise plastic, or metal, dowel rods sized to fit the holes in the side walls of containers 12, 14 and 16.

The base 26 may comprise an approximately U-shaped metal, or plastic, dowel rod having the ends of the U bent at approximately right angles to, and in the same direction from, the plane of the bottom, or bight section, of the U. Thus, the base defines two, approximately right-angled, sections, one section having free ends **26*a* adapted to fit into bottom and rear holes 74, 78, and the other section providing a U-shaped bight 26*b* adapted to lie against a flat support surface S. The horizontal stand, rests on the support surface, as shown in FIG. 2. The base 26 consequently provides means selectively connectible to and operatively associated with the portion of the tray that is distal from the front support edges 52** for maintaining the tray at an inclined attitude when on a horizontal surface such as a counter top.

It will, of course, be understood that modification of the present invention in its various aspects will be apparent to those skilled in the art, and the scope of this invention is to be measured only by the scope of the appended claims.

What is claimed is:

1. In a knock-down, multi-tiered article storage and display rack, wherein article storage and shipping trays are assembled into multi-tiered upright displays, the tiers being vertically separated by spacers, for placement on a horizontal support surface, the improvement comprising, in combination:

a plurality of said article storage and shipping trays disposed in inclined display positions for goods adapted to be packaged and shipped in said trays, said trays each including a substantially rectangular base and three adjacent upright retaining walls connected to and extending transversely above the base along the front and two side edges of the base, the height of said walls being selected to provide lateral restraint for packaged goods packed in and on the tray, each of said trays being adapted for being positioned in a horizontal storage position or an inclined display position;

each of said trays also including display panel means secured to an upper portion of the front one of the three upright walls, said display panel means being inclined outwardly and downwardly from said upright tray wall to a level spaced above a projection of the plane of the lowermost side of the base, forming with the front edge of the base, a front horizontal support means for the tray; and base means selectively connected to and operatively associated with a portion of the lowermost of said trays distally of said front horizontal support means for the tray for maintaining the tray at said inclined display position when the tray is positioned on a substantially horizontal support surface, and the front horizontal support means on said lowermost tray being coplanar with the lower extremity of said base means.

2. A construction as in claim 1 wherein each tray and all portions thereof are molded integrally of plastic to provide a unitary part.

3. A construction as in claim 2 wherein the upper and lower edges of each of the two walls bounding opposite sides of the tray are molded to provide respectively therein a pair of elongated holes whose axes are substantially parallel to the plane of the display panel means.

4. A construction as in claim 3 including elongated column member supports positioned in the elongated holes in the upper edges of walls on a lower tray and in the elongated holes in the lower edges of the walls of an upper tray, to provide means for supporting one storage tray above another in parallel relation to each other, and in inclined relation to a support surface, and thereby providing a visual display of all goods on the display rack.

5. A construction as in claim 1 wherein the means selectively connectible to one said tray includes upright means whose upper ends engage and connect to the tray adjacent its rear end, and a horizontal stand integral with upright means for resting on a support surface.

6. A construction as in claim 5 wherein the combination includes column members, and the two walls adjacent opposite sides of each tray are provided, in upper and lower edges thereof, with holes therein for receiving the ends of the column members, to provide for stacking of a plurality of trays as a multi-tiered display array.

7. A construction as in claim 6 wherein the holes are axially elongated, and holes in the respective upper and lower edges of a side of a tray are substantially axially aligned with each other.

8. A construction as in claim 1 wherein the display panel means is located within the laterally projected confines of the tray.

9. A construction as in claim 1 wherein the display panel means includes a panel having a size and shape suitable for receiving an advertising display thereon.

10. A construction according to claim 1 wherein said horizontal support means is selected to provide an inclined display position at an angle of between about 20° and about 40° between said trays and the counter top.

11. In a modular display rack having a plurality of substantially identical trays for multi-tiered displaying for sale the articles in said trays, and vertical support means connecting vertically spaced pairs of trays assembling a vertical array of connected trays, and a selectively connectible base supporting the multi-tiered array of connected trays, the improvement comprising, in combination:

each tray comprising a molded plastic structure having a substantially rectangular base with an integral upright front wall and two adjacent spaced side walls extending above said base, and with a front display panel projecting downwardly and forwardly from the upper edge of the upright front wall; the base, front wall and side walls cooperating to provide an approximately parallelepiped cavity enclosed on four sides and said tray providing a box-like cavity adapted to have packaged products positioned therein;

said side walls projecting forwardly of said front wall to connect to opposing first and second lateral edges of the display panel, and being shaped to define a support plane that is inclined relative to the base of the tray, and which makes an acute support plane angle with the underside of said tray base; and the lowermost tray having means formed thereon receiving and holding the selectively connectible base, the support plane of said lowermost tray being coplanar with the lower extremity of said selectively connectible base whereby said support plane of the bottom tray in the array is supported in supporting engagement with a substantially horizontal support surface for maintaining said array at an article display position inclined relative to the horizontal support surface.

12. An improvement according to claim 11 wherein said vertical supports are column members held in dowel fashion by said means for receiving and holding the vertical supports.

13. An improvement according to claim 12 wherein said column members are plastic.

14. An improvement according to claim 11 wherein said support plane angle is between about 20° and about 40°.

* * * * *